United States Patent [19]

Chen

[11] Patent Number: 5,020,800

[45] Date of Patent: Jun. 4, 1991

[54] SHOCK DAMPING AND ABSORBING RACKET

[76] Inventor: Dennis Chen, 293 Pei Tun Road, Taichung, Taiwan

[21] Appl. No.: 499,654

[22] Filed: Mar. 27, 1990

[51] Int. Cl.[5] ..... A63B 49/02

[52] U.S. Cl. ..... 273/73 G

[58] Field of Search ..... 273/73 R, 73 C, 73 D, 273/73 G

[56] References Cited

U.S. PATENT DOCUMENTS 4,196,901 4/1980 Durbin ..... 273/73 G 4,690,405 9/1987 Frolow ..... 273/73 C

FOREIGN PATENT DOCUMENTS 8801186 2/1988 European Pat. Off. ..... 273/73 D 2752624 5/1979 Fed. Rep. of Germany .... 273/73 C

*Primary Examiner*—Edward M. Coven

*Assistant Examiner*—William Stoll

[57] ABSTRACT

A shock damping and absorbing racket comprises a frame substantially in an oval form and a handle extending therefrom. A groove is made around the periphery of the frame. A plurality of through holes are evenly spaced along the groove, through which the string is interwoven to form a large striking surface within the frame. A rib is across the two opposite lateral side of the frame, making the vertical taut strings to cross it in such a way that one portion of the string crosses over the rib and another portion of the same string crosses under the rib so as to rapidly and efficiently stop and prevent the transmission of shock waves.

3 Claims, 2 Drawing Sheets

A-A

B-B

SHOCK DAMPING AND ABSORBING RACKET

BACKGROUND OF THE INVENTION

The present invention relates to a racket and more particularly to a shock damping and absorbed racket.

Generally, upon striking the ball, the rapid impact of the ball against the racket will cause the string web which is surrounded by the racket frame to generate strong shock waves which will then be transmitted to the player's hand. Such shock waves not only cause the player to feel uncomfortable but result in an athletic injury after prolonged exposure, so the player's interest in tennis or the like is reduced. Conventional shock absorbing rackets mostly use the technique of perforating the racket itself or attaching an elastic shock absorbing member directly to the string web, which are either cumbersome, inconvenient, or negatively affect the aesthetics.

Further, the integrality of the string web and the striking surface may become inferior as well.

SUMMARY OF THE INVENTION

The object of the present invention is to provide a racket which can considerably reduce the impact of shock waves generated by the string web on the player's hand, so as to allow the player to use the racket smoothly without any trouble.

Therefore, a shock damping and absorbing racket in accordance with the present invention comprises a frame substantially in an oval form and a handle extending therefrom. A groove is made around the pheriphery of the frame; a plurality of through holes are evenly spaced along the groove, through which the string is interwoven to form a large web within the frame. A rib is located between the handle and the frame, causing the vertical taut strings to cross it one by one in such a way that a prior portion of the string crosses over the rib and a posterior portion of the same string crosses under the rib, so as to rapidly and efficiently prevent the shock waves from transmitting to the player's hand.

The above and other objects, features and advantages of the present invention will be apparent from the following detailed description of preffered embodiment taken in conjunction with the accompanying drawings.

DETAILED DESCRIPTION OF THE PREFERRED EMBODIMENT

Figure 1:
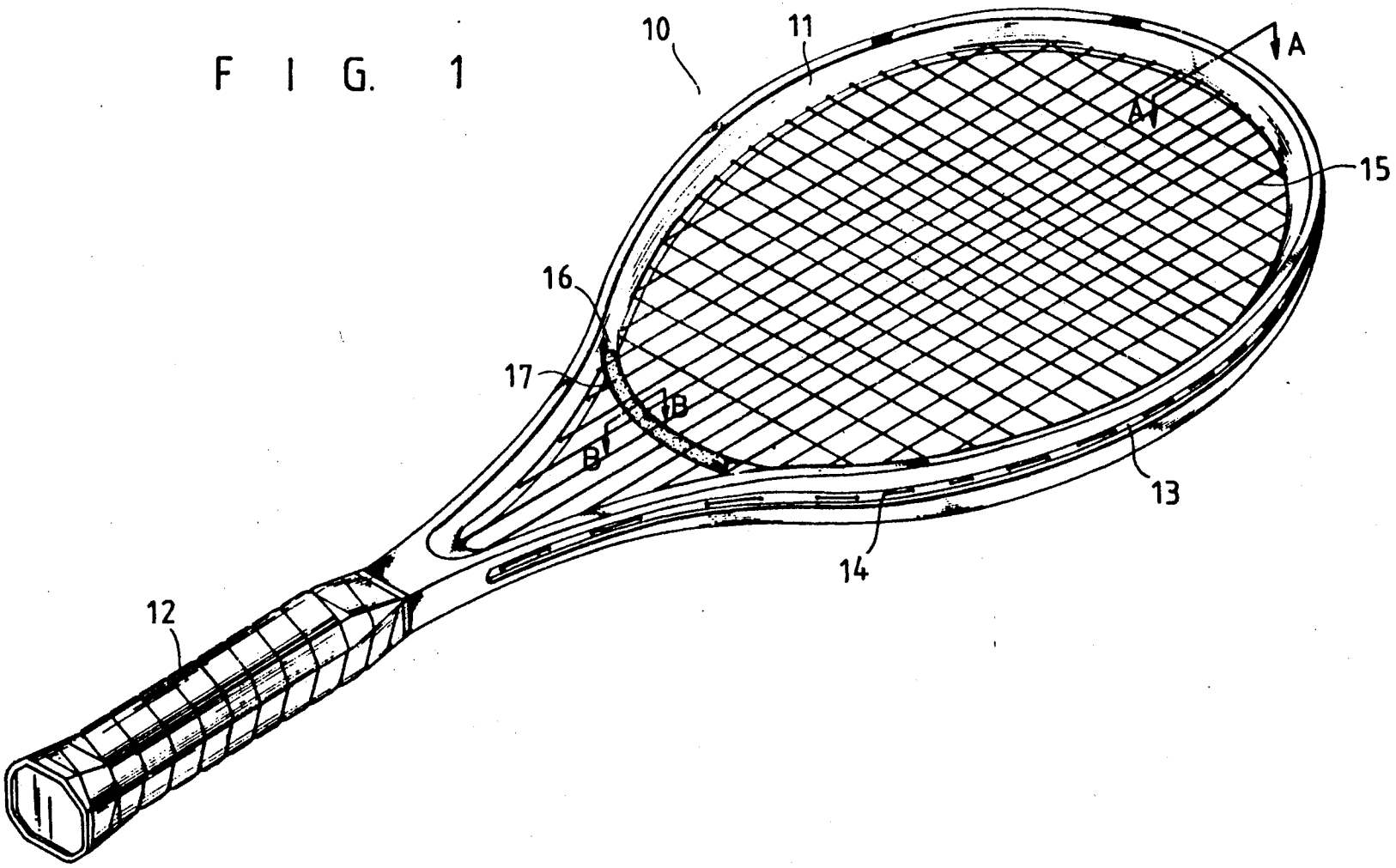
FIG. 1 is a perspective view of a racket illustrating a preferred embodiment of the prevent invention.
Figure 2:
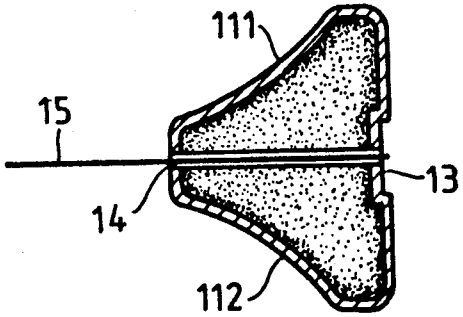
FIG. 2 is a sectional view taken along the line 1A—1A of FIG. 1.

Referring to FIG. 1, the present invention relates to a shock absorbing racket. The racket 10 comprises a frame 11 substantially in an oval form and a handle 12 extending from the two opposite lateral sides at the bottom of the frame 11. Similar to those conventional rackets, the racket 10 of the present invention is made of carbon fiber, glass fiber or the like as raw material. As shown in FIG. 2, both the corresponding curved top and bottom surfaces 111, 112 of the frame 11 are inclined inwardly so that the width of the outer periphery of the frame 11 is larger than the width of the inner periphery of the frame 11. A groove 13 is formed around the periphery of the frame 11; a predetermined number of through holes 14 penetrates the frame 11 and are evenly spaced along the groove 13, through which the vertical and transverse strings 15 are tautly interwoven to form a large web having a predetermined tensile force, thus it is provided with a striking surface having more striking zones.

Figure 3:
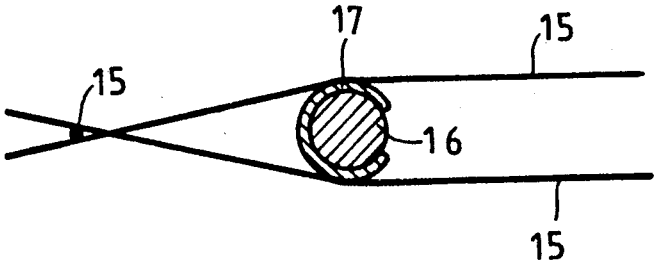
FIG. 3 is a sectional view taken along the line 1B—1B of FIG. 1.

Referring to FIGS. 1 to 3, a solid curved thin rib 16 which is connected to the two opposite lateral sides of the frame 11 at the throat portion of the racket having a round section and made by the same material as used for the racket 10 is integrally formed with the racket 10, making the whole configuration of the racket 10 continuous without any interruption, so its strength will not be affected at all. The cross-section diameter of the rib 16 is much smaller than the vertical width of the frame 11. The rib 16 has no hole at all. Thus the rib 16 is different from the conventional throat portion of a conventional frame which has holes in the throat portion. Vertical strings 15 cross the rib 16 one by one in such a way that the string 15 passes through the bottom end of the frame 10 and turning back to the top of the frame 10 so that a prior portion of the string 15 crosses over the rib 16 and a posterior portion of the same string 15 crosses under the rib 16. The vertical distance between the rib 16 and the vertical string 15 is approximately 0.2 mm. With such a rib 16, when shock waves are generated and transmitted via the strings 15 to the rib 16, they can be considerably weakened and prevented from continuing the transmission towards the handle 12, of which the principle is like playing guitar, the strummed string may rapidly stop oscillating ant the transmission of shock waves be greatly eliminated if we use a damper to press them. The rib 16 has the same function as a damper. Referring to FIG. 3, an additional protective casing 17 of shock absorbing material covers the periphery of the rib 16, making advantage of the feature of such a shock absorbing material to further stop and absorb the shock waves concerned. In this case, the player can use the racket to strike the ball more efficiently and smoothly, thus reducing the possible athletic injury to the minimum, relieving the player's worry in this respect and enhancing his interest in the tennis or the like.

When the player uses the shock absorbing racket of the present invention for tournament or exercise, the rib intergrally formed with the racket will make those vertical prior taut string to cross the rib one by one in such a way that a portion of the string crosses over the rib and a portion of the same string crosses under the rib, so as to stop and prevent the shock waves generated by the string web from transmitting to the player's hand which holds the racket. Further, an additional shock absorbing protective casing which covers the periphery of the rib reinforces the function of absorbing shock. In this case, the player is able to use the racket to strike the ball more efficiently and smoothly, thus bringing his potentiality to the full extent. On the other hand, the shock absorbing racket of the present invention is more convenient and does not affect the integrality of the striking surface, as compared with the conventional rackets ones which are mostly to perforate the racket itself or to attach an elastic shock absorbing member directly to the string web for the purpose of absorbing the shock. As a result the defects and disadvantages encountered in the tennis sports or the like for many years have been solved by the present invention now.

I claim:

1. A shock damping and absorbing racket comprising: a frame substantially in an oval form and a handle extending from two opposite lateral sides at the bottom of said frame;

a groove formed around the outer periphery of said frame;

said groove having a plurality of through holes evenly spaced along said groove;

a plurality of vertical and transverse strings passing through said holes and interweaving to form a large web within said frame;

a thin, curved, and reinforced rib integrally formed with said frame and connected to said two opposite lateral sides of said frame disposed at a throat portion of said frame, the vertical distance between said rib and said vertical string is approximately 0.2 mm;

wherein said vertical taut strings cross said rib in such a way that a prior portion of each said vertical taut string crosses over said rib and a posterior portion of each said vertical taut string crosses under said rib, and whereby said reinforced rib can rapidly and efficiently stop and prevent the transmission of shock waves.

2. A shock damping and absorbing racket as claimed in claim 1, wherein said thin rib is solid without any hole and the cross-sectional diameter of said thin rib is smaller than the vertical width of said frame.

3. A shock damping and absorbing racket as claimed in claim 1, wherein a protective casing made of shock absorbing meaterial covers the outer periphery of said rib, whereby said racket is reinforced and the vibration generated by said strings is absorbed by said shock absorbing casing.

* * * * *